United States Patent [19]

Boenisch

[11] Patent Number: 4,750,540

[45] Date of Patent: Jun. 14, 1988

[54] METHOD OF, AND APPARATUS FOR, MANUFACTURING FOUNDRY MOLDS, ESPECIALLY FOR COMPACTING FOUNDRY MOLDING MATERIAL

[75] Inventor: Dietmar Boenisch, Achen, Fed. Rep. of Germany

[73] Assignee: Georg Fischer AG, Schaffhausen, Switzerland

[21] Appl. No.: 842,232

[22] Filed: Mar. 21, 1986

[30] Foreign Application Priority Data

Mar. 28, 1985 [DE] Fed. Rep. of Germany ..... 3511283

[51] Int. Cl.[4] ..... B22C 15/28

[52] U.S. Cl. ..... 164/38; 164/195; 164/200; 164/207; 164/37

[58] Field of Search ..... 164/37, 38, 39, 40, 164/169, 187, 192, 195, 196, 200, 201, 202, 203, 207

[56] References Cited

U.S. PATENT DOCUMENTS 3,807,483 4/1974 Buhler ..... 164/202

FOREIGN PATENT DOCUMENTS 2814140 10/1979 Fed. Rep. of Germany ..... 164/202
3321955 12/1984 Fed. Rep. of Germany ..... 164/200
471151 9/1975 U.S.S.R. ..... 164/169

*Primary Examiner*—Nicholas P. Godici
*Assistant Examiner*—Richard K. Seidel
*Attorney, Agent, or Firm*—Werner W. Kleeman

[57] ABSTRACT

Foundry molding material is poured or pneumatically infed into a mold frame arrangement containing at least one pattern, a molding frame and a filling frame. Subsequently, the foundry molding material is compacted by a compacting arrangement containing, for example, any one of a compressed-air surge compacting device, a combustion-force surge compacting device, a pressure compacting device, a vibrational compacting device or a combined pressure-and-vibrational compacting device. Also during such compacting operation at least the predominant portion of the foundry molding material contained in the filling frame is displaced into the molding frame. During such compacting operation a preselected expanding gas is infed into predetermined local regions of the foundry molding material while such material is being compacted. As a result, there are formed zones of reduced packing density in the foundry molding material. During the further compacting operation, but in any case at the end of such compacting operation, the zones of reduced packing density are eliminated and the packing density of such zones is at least approximately equalized with the packing density prevailing in the remaining zones of the foundry molding material.

56 Claims, 6 Drawing Sheets

METHOD OF, AND APPARATUS FOR, MANUFACTURING FOUNDRY MOLDS, ESPECIALLY FOR COMPACTING FOUNDRY MOLDING MATERIAL

BACKGROUND OF THE INVENTION

The present invention relates to a new and improved method of, and apparatus for, manufacturing a foundry mold, especially for compacting foundry molding material.

In its more particular aspects, the present invention specifically relates to a new and improved method of, and apparatus for, manufacturing a foundry mold from a foundry molding material which is poured or pneumatically infed into mold frame means containing mold pattern means including one or more mold patterns, a molding frame and a filling frame. Subsequently, the foundry molding material poured or pneumatically infed into the mold frame means is compacted by compacting means, for example, by any of compressed-air surge compacting means, combustion-force surge compacting means, pressure compacting means, vibrational compacting means or combined pressure-and-vibrational compacting means. During such compacting operation the entire or at least a predominant portion of the foundry molding material present in the filling frame is displaced into the molding frame.

The strength or stability of foundry molding materials, particularly of bentonite-bonded sand molds is achieved by compacting the foundry molding material which has been loosely poured or pneumatically infed into the mold frame means. As the most important compacting operations there are considered the operations of jarring, jolting or vibrating; jarring, jolting or vibrating in combination with squeezing or pressing, suction pressing, blast pressing, high-pressure pressing and, for a number of years to an increasing degree, surge compacting using compressed air or the combustion gas obtained by ignition of combustible gas mixtures.

Increasing demands on the technical quality of castings or cast workpieces result in increasing requirements concerning the technical quality of the mold containing the foundry molding material. As an example of such castings or cast workpieces which progressively become more complicated, there are mentioned herein cast elements or members used in the automotive industry. In particular there are desired high dimensional precision and fine surface finish which can only be ensured by mold frame means containing uniformly compacted foundry molding material having a uniform density distribution and a uniform strength or stability distribution throughout the mold packing. However, all known compacting methods encounter fundamental difficulties which are caused by the poor pourability of clay-bonded foundry molding materials and by the partially very significant differences in the height and volume of the mold patterns which are placed in the mold frame means. Furthermore, the pattern plates tend to be more and more densely packed with mold patterns for economical reasons and conjointly therewith the distance or spacing between the individual mold patterns as well as the spacing between such mold patterns and the wall of the mold frame means is reduced to an ever increasing extent. As a result, the foundry molding material encounters progressively increasing difficulties for thoroughly shaping or molding the foundry molding material disposed in the intervening spaces in the presence of a sufficient compacting pressure and so as to assume or develop sufficient strength or stability at such locations or critical regions.

Presently used mold manufacturing means are capable of producing very high compacting pressures, however, do not achieve conjointly therewith uniform compaction throughout the foundry molding material. Frequently, and quite to the contrary, the non-uniformity of the packing density of the foundry molding material and its particles or grains and thus also the non-uniformity of the dimensional stability within one and the same mold, in fact, tend to increase with increasing compacting pressure. These effects are caused by laterally directed forces which increasingly occur at high compacting pressures in the foundry molding material above large-area mold patterns which cause strong dam-up or blockage effects. Such lateral forces result in plug formation, that is in the formation of highly compacted bridges of the foundry molding material which extend between the intermediate mold regions and render difficult the access of the foundry molding material and the compacting pressure into the cleft-shaped or slot-shaped regions therebelow. Due to such lateral forces, there is also particularly impaired the edge or peripheral compaction between the mold patterns and the wall of the mold because in the related circumferentially extending zone of the sand mold containing the foundry molding material the effective compacting pressure head is diminished in any case due to the friction existing between the foundry molding material and the wall of the mold frame means. As a consequence, the packing of the foundry molding material is not sufficiently supported in the mold frame means and this results in the extremely feared offset or shift phenomena. Deep-level packing portions frequently are poorly shaped or molded to such an extent that such deep-level packing portions may already rupture during the mold pattern withdrawal or may yield during the subsequent casting operation, thus producing dimensional imprecisions in the casting or cast workpiece. Further faults like edge wear, erosion and penetration are also the consequence.

SUMMARY OF THE INVENTION

Therefore, with the foregoing in mind, it is a primary object of the present invention to provide a new and improved method of, and apparatus for, manufacturing a foundry mold, especially for compacting foundry molding material, and which method and apparatus are not afflicted with the drawbacks and limitations of the prior art constructions heretofore discussed.

Another and more specific object of the present invention is directed to a new and improved method of, and apparatus for, manufacturing a foundry mold and which result in substantially uniform compaction of the foundry molding material throughout the mold and thereby thoroughly improve the quality of the produced castings.

Now in order to implement these and still further objects of the invention, which will become more readily apparent as the description proceeds, the compacting method of the present development is manifested by the features that, during the compacting operation, a preselected gas is infed into and expanded in predetermined local regions of the foundry molding material. There are thus produced zones of reduced packing density of the foundry molding material. During the further course of the compacting operation the zones of reduced packing density are eliminated and the packing density of these zones is brought to or made at least approximately equal to the packing density prevailing in the remaining zones of the foundry molding material.

The inventive method thus achieves the beneficial result that loose regions are formed or built up in partial and predeterminable regions of the foundry molding material and such loose or loosely packed regions result in an improvement of the mobility or flow properties of the foundry molding material during the compaction of such foundry molding material.

Depending upon the type and the amount as well as the direction and time duration of the action of the preselected gas or compressed gas and depending upon the spatial arrangement of the mold patterns in the mold frame means, as well as upon further controllable parameters, there can be produced in accordance with the invention, very differently dimensioned predetermined local regions of reduced packing density in the foundry molding material. Such differently dimensioned regions can be classified as two different types of regions of reduced packing density:

(i) In the first type of such regions in which the foundry molding material is maintained in a loose or loosely packed condition, the high packing density and thus an agglomeration or agglutination of the particles of the foundry molding material is greatly reduced during the compacting operation. As a result, the foundry molding material is delivered to the particularly insufficiently supplied regions or difficultly accessible regions within the molding frame in a sliding manner comparable to a sliding displacement or movement which is enabled by using an air cushion. In this manner, there is also achieved the result that there cannot be built up a closed compaction front or head which must be interrupted and remain open in certain locations so that the required compacting pressure can be applied to the critical regions of the foundry molding material in the molding frame. There is also extensively prevented the build-up of the previously mentioned dangerous bridges formed of the foundry molding material and which extend over deep-level regions of the mold packing at indentations of the mold patterns as well as between or adjacent such mold patterns. At the same time there is achieved the beneficial effect that bridges are prevented from forming right from the start of the compacting operation and that previously formed bridges are effectively destroyed. As a result, there is obtained a uniform supply of foundry molding material and a uniform application of compacting pressure to the deep-level or lower situated regions and thus the strength or stability distribution throughout the entire mold packing is rendered much more uniform.

(ii) The second type of region having reduced packing density is formed by infeeding or rendering effective the preselected gas in partial or preselected, particularly predetermined local regions of the foundry molding material at such gas concentration that voids or cavities are formed much in the manner of an explosion. As a result, the thus compressed gas conveys the foundry molding material and pre-compacts the foundry molding material due to the pressure which is exerted during such conveying operation. In accordance with the invention there are thus present small "pre-compactors" in regions which are difficultly accessible by the conventional compacting operation using compacting means which act from the exterior and on the top of the foundry molding material in the mold frame means, when the predetermined local regions of reduced packing density of the second type are generated in such regions.

Modifications are possible in the range between the aforementioned two different types of predetermined local regions having reduced packing density. Thus, definable or limited loose or loosely packed regions can be generated by infeeding compressed air into the foundry molding material and such definable or limited loose or loosely packed regions are dependent upon the pressure, the manner of infeeding and the time of action of the compressed air. Definable or limited loose or loosely packed regions can also be produced by means of a combustible or combustion gas. When, for example, a combustible gas is infed into the foundry molding material at high local concentrations and when such combustible gas is ignited immediately thereafter, then, there are obtained in an explosion-like manner very distinct or defined voids or cavities in the foundry molding material and such voids or cavities constitute the second type of the predetermined local regions of reduced packing density. As a result, the foundry molding material is conveyed and compacted or pre-compacted by the compressed gas which is formed within the foundry molding material.

When, however, the combustible gas or gas mixture such as, for example, a natural gas-air or natural gas-oxygen mixture, an acetylene-air or acetylene-oxygen mixture, or a gasoline-air or gasoline-oxygen mixture is infed into the foundry molding material in a manner such that the combustible gas or gas mixture is firstly distributed in a preselected manner through the foundry molding material and ignited only thereafter, then, there is obtained only a slow combustion with the result that the particles or grains of the foundry molding material are lifted off from each other, whereby the foundry molding material assumes a condition of improved pourability or flowing capability.

The type and the amount of the combustible gas or gas mixture or of the combustion gas, the location of its introduction into the foundry molding material and its effect, particularly its temperal action upon such foundry molding material permits, therefore, producing predeterminable regions of a preselected loose or loosely packed condition and thus of corresponding pourability or flowing capability of the foundry molding material.

In addition to the aforementioned measures a predetermined direction can be imparted to the expanding preselected gas or gas mixture within the foundry molding material and such direction governs the pourability or the flow characteristics of the foundry molding material. It is thus proposed as a particularly advantageous measure according to a further development of the inventive method that an inflow direction is imparted to the expanding preselected gas within the foundry molding material such that the inflow direction favors a direction or displacement of the foundry molding material in correspondence with the mold pattern coverage or the mold pattern structure.

It is a decisive feature of the inventive method that the loose or loosely packed regions only exist for short periods of time or only transiently and are removed or eliminated again during the further course of the compacting operation, in any case until the end of such compacting operation. Otherwise, there would remain again non-uniformities of compaction within the interior of the mold packing.

As already alluded to above, the invention is not only concerned with the aforementioned method aspects, but also relates to an improved construction of an apparatus for manufacturing a foundry mold, especially for compacting foundry molding material.

In order to achieve the aforementioned objects, the inventive apparatus comprises:

a pattern plate;

at least one mold pattern mounted on the pattern plate;

a molding frame surrounding the at least one mold pattern and defining an interior space partially filled by the at least one mold pattern and for receiving foundry molding matrial;

a filling frame mounted on top of the molding frame and defining an interior space for receiving the foundry molding material;

compacting means arranged above the filling frame for compacting the foundry molding material;

the pattern plate, the at least one mold pattern, the molding frame, the filling frame, and the compacting means constituting mold frame means; and the mold frame means containing a predetermined number of apertures or openings for infeeding into and expanding a preselected gas in predetermined local regions of the foundry molding material in order to thereby transiently generate regions of reduced packing density of the foundry molding material during operation of the compacting means.

The inventive apparatus which permits producing, during the compacting operation by the compacting means, predetermined or preselected local regions of reduced packing density while the foundry molding material is being compacted, may be used with different types of known compacting means. In the case that the compacting means contain a compressed-air surge compacting means it is advantageous in most cases to select compressed air as the infed and expanding gas for producing the loose or loosely packed zones within the foundry molding material. If possible, such compressed air is derived from the compressed air used in the compressed-air surge compacting means. When thus the compacting means constitutes a gas or the compacting means constitute gas-operated compacting means, then the preselected gas which is infed into the foundry molding material for producing the loose or loosely packed zones, should be of the same type. Therefore, when the compacting means constitute a combustion-force surge compacting means, a combustion-force surge compacting means should also be used for producing the loose or loosely packed zones within the foundry molding material.

Generally, surge means for producing the loose or loosely packed zones within the foundry molding material can be derived from the surge compacting means for compacting the foundry molding material. This has the advantage that their times or moments of action can be precisely matched because, as already mentioned hereinbefore, the loose or loosely packed zones within the foundry molding material are produced only within the time duration of the compacting work and are no longer present at the end of such compacting work.

In the case that the compacting means constitute any one of a pressure compacting means, a vibrational compacting means or a combined pressure-and-vibrational compacting means, it is advantageous in many cases when compressed air is used as the preselected expanding gas. The reason therefor is that compressed air generally is also used for driving the aforementioned compacting means. Since the pressing and vibrating actions extend over a time duration of a number of seconds, the loose or loosely packed zones formed within the foundry molding material during the compacting operation, are produced throughout a correspondingly longer time period of compaction when compressed air is used as the preselected gas for producing the loose or loosely packed zones within the foundry molding material.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that only enough of the construction of the different embodiments of the inventive apparatus have been shown as needed for those skilled in the art to readily understand the underlying principles and concepts of the present development, while simplifying the showing of the drawings. Turning attention now specifically to FIG. 1 of the drawings, there has been shown a schematic vertical section through a first exemplary embodiment of the inventive foundry mold manufacturing apparatus. This first embodiment contains compressed-air surge compacting means 70 in combination with mold frame means 100 containing a pattern plate 1. The compacting means 70 also may be of a different type, and thus conceptually may be considered to be any one of a combustion-force surge compacting device, a vibrational compacting device or a combined pressure-and-vibrational compacting device. A further type of compacting means, namely a pressure compacting device will be considered hereinafter in detail with reference to FIGS. 6 and 8.

Figure 1:
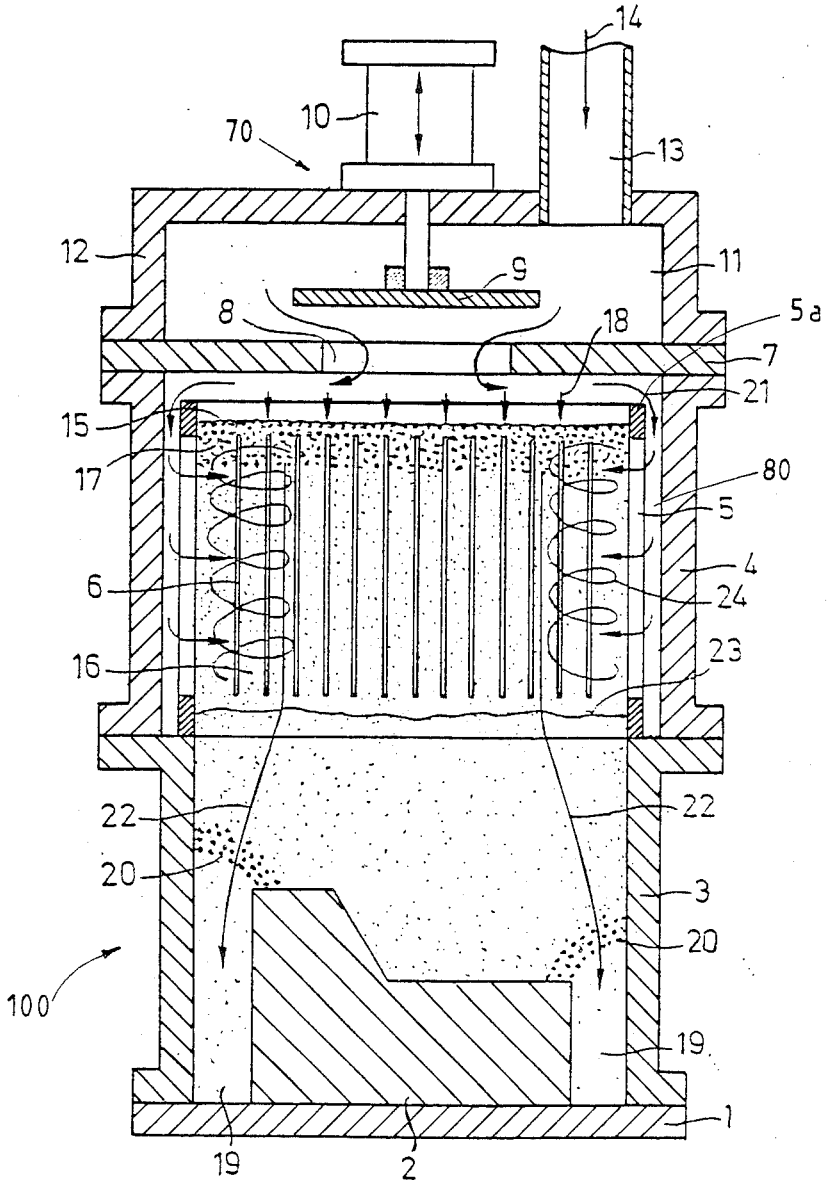
FIG. 1 is a schematic vertical section through a first embodiment of the inventive foundry mold manufacturing apparatus, especially for compacting foundry molding material.

A mold pattern 2 is also recognizable in FIG. 1 and is only schematically shown. It should be noted that different numbers, different structures and different sizes of mold patterns can be assembled on the pattern plate 1 which results in different pattern arrangements or arrays. However, for the purpose of explaining the operation and events which occur in the inventive foundry mold manufacturing apparatus, it is deemed sufficient to discuss such operation and events with reference to the only schematically indicated single mold pattern 2 because basically the same operation and events are equally applicable with respect to each pattern of such arrangements or arrays or assemblies of mold patterns on the pattern plate 1.

The mold frame means, generally designated by reference numeral 100 in FIG. 1, further contain a molding frame 3 and a filling frame 4 which bears upon the molding frame 3. In the presently described embodiment the filling frame 4 is constructed as a double-walled filling frame containing an internal frame or wall 5 extending around the entire circumference of the filling frame 4 and defining an intermediate space or passae 80. The internal frame or wall 5 is provided with a predetermined number of apertures or openings 6 which, in the presently described embodiment, are constituted by a multitude of longitudinal slots. The predetermined number of apertures or openings 6 may also be constituted by a plurality of bores or passages which extend through the interior frame or wall 5 and constitute perforated structure of such interior frame or wall 5; however, such apertures or openings may possess any other appropriately selected shape corresponding to the momentary requirements.

The interior space of the mold frame means 100 is formed by an interior space of the molding frame 3 and the interior space bounded by the internal frame or wall 5 of the double-walled filling frame 4 which is closed at the top by the bottom or base 7 of a pressure chamber 11 of the compressed-air surge compacting means 70. At least the major portion of the interior space bounded by the internal frame or wall 5 of the double-walled filling frame 4 and the remaining portion of the molding frame 3 and which remaining portion is the portion not filled by the mold pattern 2, is filled by a preselected poured-in or pneumatically infed foundry molding material, such as a suitable molding sand 16 adapted in composition to the momentary requirements. The bottom or base 7 of the pressure chamber 11 contains a large-area gap or opening 8 through which the medium which triggers the surge compacting opertion is passed. The large-area gap 8 is closed in the inoperative state of the apparatus when no compaction of the foundry molding material is accomplished, by means of a large-area valve 9 which constitutes a simple plate or disc value. The large-area gap 8 is closed in an air-tight manner by pressing or force-applying means 10 which are pneumatically or hydraulically operated. The aforementioned pressure chamber 11 is formed by a housing 12. A compressed-air supply conduit 13 opens into such housing 12 or pressure chamber 11 and a compressed-air flow 14 originates from a not particularly illustrated but conventional compressed air source, like a generally used central compressed-air supply of the foundry installation or a specific compressor station adapted to the requirements of the foundry mold manufacturing apparatus.

The pressure chamber 11 has stored therein compressed air under a pressure in the range of, for example, about 3 to about 5 bar prior to the triggering of a compacting operation. For triggering such compacting operation the plate or disc valve 9 is instantaneously upwardly pulled or retracted by releasing or otherwise appropriately operating the pressing means 10. The compressed air contained in the pressure chamber 11 thus impacts, within a few milliseconds, upon the mold back or upper surface or region 15 of the foundry molding material or molding sand 16. Due to this impact action of the compressed air the poured-in foundry molding material or molding sand 16 is initially compressed by the compaction head or compaction or pressure front 17 effective at the sand mold back or upper surface or region 15 and already significantly compacted in this region. The compaction head or compaction or pressure front 17 is strengthened by the continuously acting compacting pressure 18 until the final sand compaction is obtained due to the dam-up of the foundry molding material or molding sand 16 at the moment at which the compacting head or compaction or pressure front 17 impacts at the mold pattern 2 and at the pattern plate 1.

The specific disadvantage of compacting the foundry molding material or molding sand 16 using surge compacting means like the compressed-air surge compacting means 70 will be immediately recognized from the course of the compacting operation described hereinbefore. Actually, the compacting head or compaction or pressure front 17 which has already been significantly pre-compacted by the impact of the air upon the mold back or upper surface or region 15, must be broken up again at the moment at which such compacting head or front 17 impacts at the mold pattern 2. This is required in order to provide the critical molding or packing regions 19 which foundry molding material or molding sand 16 and with the pressure required for compacting such molding sand 16 in such critical molding or packing regions 19. The break-up of the compacting head or front 17 results in the loss of valuable compacting energy and furthermore leads to a build-up of blocking or dam-up bridges 20 which additionally render difficult the thorough shaping or molding of the foundry molding material or sand 16 in the critical molding or packing regions 19. There is thus obtained the result that, after compaction, there is measured a compression strength of, for example, 30 $N/cm^2$ directly above the mold pattern 2 in the compacted foundry mold, whereas only a compression strength of 5 $N/cm^2$ is measured in the insufficiently supplied critical molding or packing regions 19 which are insufficiently supplied with molding sand and compacting pressure. These marked density and strength or stability differences are extremely detrimental to the quality of the casting or cast workpiece which is produced by using such mold.

The present invention contemplates avoiding these drawbacks or limitations and infeeding into and expanding a preselected gas, for example, compressed air or any other appropriately selected gas or gas mixture, in predetermined local regions of the foundry molding material or molding sand 16 while the same is being compacted and to thus transiently build-up and maintain loose or loosely packed zones in the interior of the mold packing formed by such molding sand 16. Such loose or loosely packed zones to a significant extent contribute in improving the movability or mobility of the foundry molding material or molding sand 16 during the compacting operation. This is achieved because, during such compacting operation, the agglomeration or agglutination of the particles or grains of the molding sand 16 is prevented within such zones in which the molding sand 16 is maintained in a loose or loosely packed condition. As a result, the foundry molding material or molding sand 16 is fed to the insufficiently supplied and critical molding or packing regions 19 in a sliding manner corresponding to sliding movement on an air cushion. In this manner, there can also be achieved the desirable result that no closed or continuous compacting head or front 17 can be formed. In fact, the compacting head or front 17 remains non-continuous or interrupted and thus extensively prevents the build-up of the dangerous blocking and bridges or dam-up 20.

In the first exemplary embodiment of the inventive foundry mold manufacturing apparatus illustrated in FIG. 1, the compressed air enters the intermediate space 80 of the double-walled filling frame 4, see the arrows 21, immediately after the plate or disc valve 9 has been opened. The compressed air further enters the foundry molding material or molding sand 16 laterally and around the circumference of the internal frame or wall 5 of the double-walled filling frame 4 through the apertures or openings 6 which here are constituted by longitudinal slots in the presently described embodiment. As a result, there is formed close to the entire internal frame or wall 5 of the double-walled filling frame 4 a predetermined local region in which the foundry molding material or molding sand 16 is maintained in a loose or loosely packed condition or state due to the expanding compressed air throughout the predominant portion of the compacting operation and during this time friction between the molding sand 16 and the internal frame or wall 5 of the double-walled filling frame 4 remains nearly eliminated. This predetermined local region 24 contains a reduced packing density of the foundry molding material or molding sand 16. The molding sand 16, as indicated by the arrows 22, slides through and along these loose or loosely packed regions 24 to a greater extent into the critical molding or packing regions or edge regions 19 where significantly improved sand strengths or stabilities are achieved. The predetermined local regions 24 of reduced packing density may also be described as regions which contain occulsions of the expanding gas, i.e. air in the presently described embodiment in which the infed and expanding gas constitutes compressed air.

As a consequence of the compacting operation, the sand mold back or upper surface or region 15 migrates from the position shown in FIG. 1 into the position shown at 23. Thus, the foundry molding material or molding sand 16 leaves the local regions 24 of reduced packing density associated with the apertures or longitudinal slots 6 in the internal frame or wall 5 of the double-walled filling frame 4 at the end of the compacting operation or compacting travel path. Due to the continuously acting compacting pressure 18, the molding sand 16 is thus ultimately tightly compressed or compacted. Loose or loosely packed zones which may have remained in the mold packing, are thereby eliminated and the packing density of these regions 24 is brought or approximately made equal to the packing density in the other regions of the molding sand 16 after sand compaction. There is thus obtained the beneficial result that means are effective for loosening the molding sand 16 in predetermined local regions at the start of the compacting operation or during such compacting operation, but are released or rendered ineffective in any appropriate manner towards the end of such compacting operation.

In order to obtain successful foundry or molding sand compaction the size and extension of the loose or loosely packed zones or local regions 24 must be precisely adapted to the requirements of the casting manufacturing operation in the inventive foundry mold manufacturing apparatus. The extension of the circumferentially extending loose or loosely packed zones or local regions 24 is determined, inter alia, by the viscosity of the preselected and compressed gas, by the pressure of the compressed gas and by the width of the apertures or openings 6, i.e. by the width of the longitudinal slots in the internal frame or wall 5 of the double-walled filling frame 4. The width of such longitudinal slots can be determined or varied in accordance with the degrees of difficulty encountered due to the pattern arrangement or array on the pattern plate 1 and in accordance with the height of the molding frame 3. For example, in the case of using combustion-force surge compacting means the width of the longitudinal slots in the internal frame or wall 5 of the double-walled filling frame 4 should be constructed to be very much smaller so as to form quite narrow slots for the throughpassage of the hot combustion gases as compared to the comparatively cold air originating from the compressed-air surge compacting means 70. Inadequately broad or wide longitudinal slots could result in the effect that the gas is pressed too far into the mold packing and the entire mold is destroyed.

Figure 2:
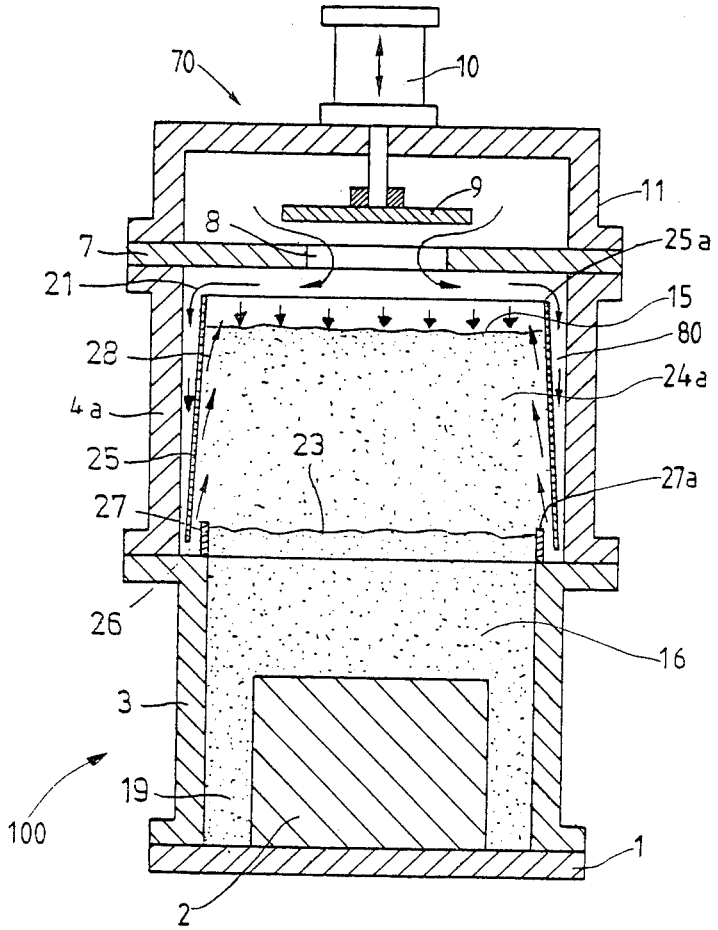
FIG. 2 is a schematic vertical section through a second embodiment of the inventive foundry mold manufacturing apparatus.

For the purpose of reliably limiting the spread of the loose or loosely packed zones or local regions, particularly in mold frame means which are relatively small and when using molding sand 16 as the foundry molding material, specific deflection means for the incoming gas flow have been found to be effective. In such relatively smaller mold frame means, the gaseous loosening medium should be directed to a lesser extent towards the center of the mold packing and instead should be conducted in the manner of a compressed air film in a narrowly confined space along the wall of the filling frame. The second embodiment of the inventive foundry mold manufacturing apparatus illustrated in FIG. 2 is provided with such deflection means and will now be considered.

The structure of the second exemplary embodiment of the inventive foundry mold manufacturing apparatus is basically analogous to the structure of the first exemplary embodiment described hereinbefore with reference to FIG. 1. Here also there are provided a molding frame 3, a pattern plate 1 with at least one mold pattern 2 mounted or supported thereupon, a double-walled filling frame **4*a* containing an internal frame or wall 25 and a tapered or converging intermediate space 80 between such internal frame or wall 25** and the filling frame 4*a*, and a pressure chamber 11 communicating with the interior space bounded by the internal frame or wall 25 of the double-walled filling frame 4*a* through a gap or opening 8 in the bottom or base 7 of the pressure chamber 11. The pressure chamber 11 constitutes part of the compressed-air surge compacting means 70 including pressing or force-applying means 10 which are operatively connected with a plate or disc valve 9 for closing and opening the gap or opening 8 formed in the bottom or base 7 of the pressure chamber 11. A predominant portion of the interior space bounded by the internal frame or wall 25 of the double-walled filling frame 4*a* and the interior space of the molding frame 3 are filled by a pouring of foundry molding material or molding sand 16. The critical molding or packing regions 19 are also clearly indicated in FIG. 2.

The internal frame or wall 25 of the double-walled filling frame 4*a* constitutes an impervious component or part which extends around the inner side of the double-walled filling frame 4*a*. In this particular embodiment the predetermined number of apertures or openings for infeeding the preselected gas into the predetermined number of local regions in the molding sand 16 constitutes a circumferentially extending annular gap or slot 26 which is formed between the lower end of the internal frame or wall 25 and the top end of the molding frame 3. On the interior side of the internal frame or wall 25 there is placed a likewise circumferentially extending annular deflecting ledge or baffle 27 which is appropriately fixedly connected with the double-walled filling frame 4*a* and the internal frame or wall 25 in such a manner that the circumferentially extending annular gap or slot 26 extends into the interior or internal space bounded by or contained within the internal frame or wall 25 of the double-walled filling frame 4*a*.

The operation of the compressed-air surge compacting means 70 corresponds to the operation described hereinbefore with reference to FIG. 1. The compressed air surge which is produced by the sudden opening of the plate or disc valve 9 impacts upon the sand mold back or upper surface or region 15 and also enters the tapered intermediate space 80 between the internal frame or wall 25 and the inside of the double-walled filling frame 4*a* as indicated by the arrows 21. Due to the impervious nature of the internal frame or wall 25, the compressed air is compelled to flow through this tapered or converging intermediate space or passage 80 and is deflected through the circumferentially extending annular gap or slot 26 and specifically at the deflecting ledge or baffle 27 such that this air is guided through a relatively narrow local region 24*a* in close proximity to the inner side or surface of the internal frame or wall 25 in an upward flow direction. This region 24*a* constitutes a region in which the molding sand 16 is transiently converted into a relatively loose or loosely packed condition due to the expansion of the compressed air. The size of the effective region in which such loose or loosely packed condition or state of the molding sand 16 is formed, can be adjusted in quite precise manner by adjusting the width of the circumferentially extending annular gap or slot 26 between the internal frame or wall 25 of the double-walled filling frame 4*a* and the deflecting ledge or baffle 27.

As described hereinbefore with reference to the operation of the first exemplary embodiment of the inventive foundry mold manufacturing apparatus illustrated in FIG. 1, the loose or loosely packed region 24*a* is only transiently formed during the time duration of the compacting operation and eliminated at the end of such compacting operation. The compacting operation should be performed in a manner which ensures that the original mold back or upper surface or region 15 is displaced downwardly towards the molding frame 3 and forms, after sand compaction, a mold back 23 which is caused to extend as closely as possible or even below the upper edge 27*a* of the deflecting ledge or baffle 27 at the end of the compacting operation.

Experiments have shown that in the embodiments of the foundry mold manufacturing apparatus illustrated in FIGS. 1 and 2 cold compressed gases like, for example, compressed air occasionally cannot sufficiently rapidly cross over the top edge 5*a* or 25*a* of the internal frame or wall 5 or 25, as the case may be, into the intermediate space or passage 80 which is respectively formed between the internal frame or wall 5 and 25 and the inner side or surface of the filling frame 4 and 4*a*. As a consequence, the sand loosening action does not commence at a sufficiently early time after the start of the compacting operation. At such time disadvantageous pre-compactions have already started within the mold packing and this results in an impaired quality of the shaping or molding of the molding sand 16 in the critical molding or packing regions 19. Such disadvantage can be mitigated at least to some extent by increasing the width of the annular inflow or inlet gap which is formed between the top edge 5*a* and 25*a* of the internal frame or wall 5 and 25, as the case may be, and the bottom or base 7 of the pressure chamber 11, or else by arranging the internal frame or wall 5 or 25, as the case may be, at an inclination such that the inflowing compressed gas or compressed air which flows into the interior space of the double-walled filling frame 4 or 4*a* through the gap or opening 8 in the bottom or base 7 of the pressure chamber 11, has easier or greater access to the intermediate space or passage 80 on the rear side or surface of the internal frame or wall 5 or 25, as the case may be, in the direction indicated by the arrows 21.

The inventive construction of the foundry mold manufacturing apparatus permits further possibilities, particularly for a relatively precise chronological control of the foundry molding material or molding sand loosening processes which occur in the predetermined local regions of the foundry molding material which is placed into the interior of the mold frame means 100 and which constitutes the mold packing.

A third exemplary embodiment of the inventive foundry mold manufacturing apparatus is illustrated in FIG. 3 and again contains a molding frame 3 which is closed on one side by a pattern plate 1 supporting a plurality of mold patterns 2, two of which are conveniently shown in FIG. 3. At the opposite end or side of the molding frame 3 a filling frame 4*b*, which here is of a single-wall construction, bears upon the molding frame 3 and is provided at the upper end remote from the molding frame 3 with compressed-air surge compacting means 70 of the type described hereinbefore with reference to FIGS. 1 and 2 or any of the hereinbefore noted other types of compacting means.

This third embodiment of the inventive foundry mold manufacturing apparatus achieves the aforementioned relatively precise control of the molding sand loosening operation during compacting by providing separate gas infeed means 29 for infeeding the preselected gas which produces predetermined local regions 24*b* of reduced sand packing density. Such infeed means 29 encompass a pressure-tight container 31 constituting an annular conduit which extends around the mold frame means 100, specifically around the single-walled filling frame 4b in this illustrated embodiment. The pressure-tight container 31 is connected to an infeed line 29a through a rapid or quick operating valve 30 which is operated in a predetermined time relationship to the operation of the compressed-air surge compacting means 70. The pressure-tight container 31 communicates by means of inflow conduits 60 with related apertures or openings 61 which are provided in the single-walled filling frame 4b.

The infeed line 29a is connected to a source of the compressed preselected gas for loosening the foundry molding material or molding sand 16 in the aforementioned predetermined local regions 24b which are formed at the inside of the single-walled filling frame 4b where the apertures or openings 61 open into the interior space of such filling frame 4b. In a preferred mode of operation, the compressed preselected gas constitutes compressed air which can be withdrawn from an appropriately selected air pressure tank or from the suitable compressed air source which supplies the compressed-air surge compacting means 70 with compressed air.

As mentioned previously, the rapid operating valve 30 of the gas infeed means 20 is operated in a predetermined time relationship with respect to the operation of the compressed-air surge compacting means 70. Such arrangement in which the gas infeed means 29 are separated from the compressed-air surge compacting means 70, is distinguished by high adaptability to changing operating conditions. Thus, for example, the compressed preselected gas used for sand loosening can be applied already at a moment of time which precedes the start of the surge compacting operation by a predetermined short period of time. During the surge compacting operation the compacting pressure 18 increases to the level of pressure or sand loosening pressure which prevails in the pressure-tight container or annular conduit 31 and consequently the pressure difference between the compacting pressure 18 and the sand loosening pressure continuously decreases and ultimately becomes zero during the course of the surge compacting operation. The sand loosening action or the predetermined local regions 24b of reduced packing density are thus eliminated towards the end of the surge compacting operation and this has been found to be advantageous under certain conditions.

Figure 3:
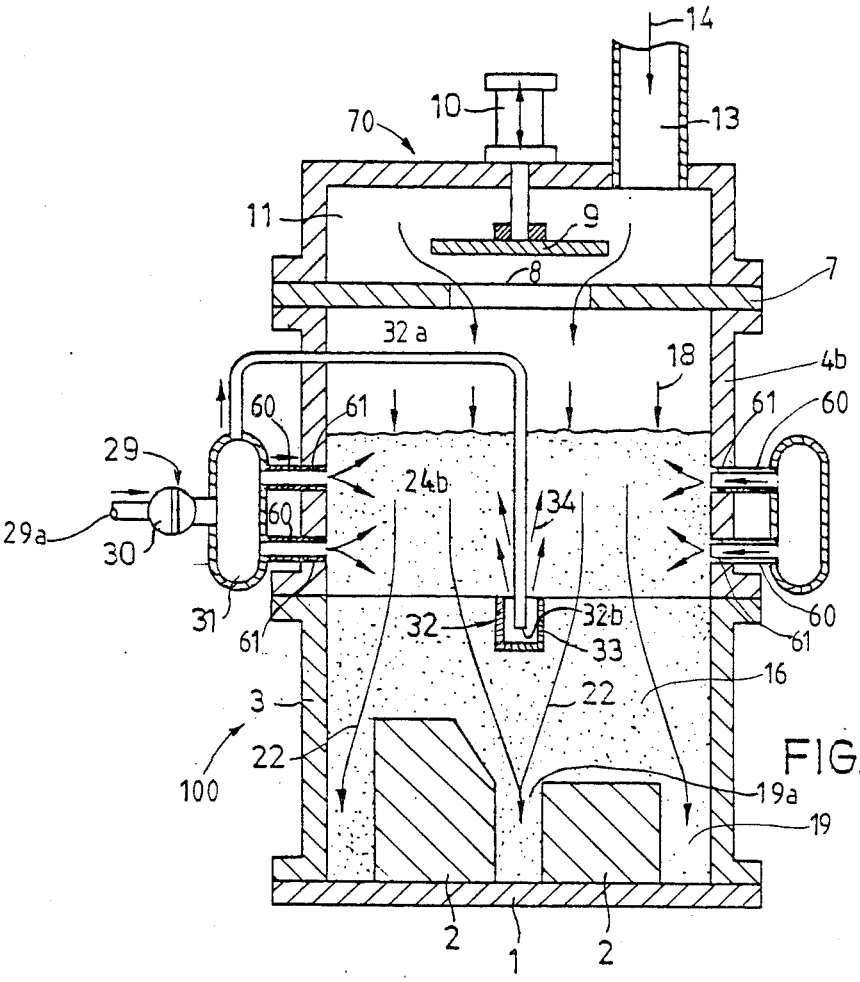
FIG. 3 is a vertical section through a third embodiment of the inventive foundry mold manufacturing apparatus.

The beneficial effects of producing the predetermined local regions 24b of reduced sand packing density are particularly effective when such regions 24b of reduced sand packing density are predominantly generated substantially above intermediate spaces which exist in the molding frame 3 between such molding frame 3 and the mold patterns 2 supported on the pattern plate 1. Such intermediate spaces, as already explained hereinbefore with reference to FIGS. 1 and 2, constitute critical molding or packing regions 19. Intermediate spaces, however, also exist between the individual mold patterns 2 which are placed on the pattern plate 1. Insufficient mold packing may also be formed in regions in which the mold pattern 2 or individual ones of the mold patterns 2 on the pattern plate 1 are structured with deep-reaching indentations. Additional blowing means 32 are illustrated in FIG. 3 and serve the purpose of affecting the formation of the mold packing also in such further critical regions or zones 19a; FIG. 3 shows the region between two mold patterns 2 as an example of such further critical regions or zones 19a. Such additional blowing means 32 have also proven advantageous in combination with large-size mold frame means 100 which contain a suitable molding sand as the foundry molding material. Also, and as shown, the additional blowing means 32 are of particular advantage when a plurality of mold patterns 2 and relatively high patterns 2 are used.

Preferably, the additional blowing means 32 contain at least one further inflow conduit 32a which extends through the wall of the single-walled filling frame 4b and enters from above into the molding sand 16 which has been poured into the mold frame means 100. The at least one further inflow conduit 32a contains at least one outflow opening or port 32b through which the preselected gas is infed into the molding sand 16.

Advantageously, and as specifically illustrated in combination with the third embodiment of the inventive foundry mold manufacturing apparatus illustrated in FIG. 3, there are further provided deflecting means 33 in the region of the at least one outflow opening or port 32b of the at least one further inflow conduit 32a. More specifically, the deflecting means 33 are of a substantially cup-shaped cylindrical construction which is open at the top and defines an upwardly directed substantially cylindrical active region 34. However, other constructions of the deflecting means 33 can be selected which possess different geometries of action and different degrees of effectiveness as concerns their adaptation to momentary encountered requirements. In this manner, the preselected gas, here compressed air, is infed and expanded in such a manner that a predetermined inflow direction is imparted to the expanding preselected gas in order to thereby favor a predetermined direction of movement of the foundry molding material or molding sand 16 governed by the difficulties encountered during formation of the mold packing due to either the type of pattern arrangement or array at the pattern plate 1 or due to the specific mold pattern structure. In fact, the optimum construction of the deflecting means 33 is advantageously adapted in each case to the prevailing operating requirements.

In the illustrated embodiment under discussion the further inflow conduit 32a is connected with the pressure-tight container or annular conduit 31. Instead, there may also be provided a separate compressed gas supply for the infeed means 29 which is controlled in conventional manner and, as already explained hereinbefore, in a predetermined time relationship to the operation of the compressed-air surge compacting means 70.

In a further modification of such illustrated embodiment, each one of the inflow conduits 60 as well as the further inflow conduit 32a can be provided with a separate rapid-operating valve of the type correspondingly to the illustrated and previously described rapid-operating valve 30. In such case, the different inflow conduits 60 and 32a may either be simultaneously operated during very short time intervals or may be operated in a staggered relationship to each other with respect to time.

The beneficial effect obtained by this third embodiment of the inventive foundry mold manufacturing apparatus is indicated by the arrows 22 in FIG. 3. These arrows 22 indicate the primary directions of movement or displacement of the molding sand 16 during the compacting operation, and these primary directions of sand movement or displacement are affected by the type and the position of the different sand loosening means, i.e. by the type and by the position of the different apertures or openings 61 in the single-walled filling frame 4b and by the type and the position of the blowing means 32. Ultimately there can thus be obtained a thoroughly improved uniformity of compaction of the foundry molding material or molding sand 16.

The aforedescribed embodiments of the inventive foundry mold manufacturing apparatus illustrated in FIGS. 1 to 3 are located in the region of the filling frame 4, 4a or 4b, as the case may be, and, in fact, are appropriately connected therewith. Such mode of construction has been found to be sufficient for many cases in which the inventive manufacturing apparatus has been employed. This is due to the fact that it has been recognized that difficulties of sand compaction are so-to-speak "preprogrammed", in other words predestined already at the start of the sand compacting operation for the reasons previously explained, and thus, particularly in the region of the relevent filling frame 4, 4a or 4b. However, in individual cases and particularly during the use of high mold frame means 100 containing molding sand 16 it has been found advantageous to extend the active region of the sand loosening means into the upper region of the molding frame 3 as will be further explained shortly.

Figure 4:
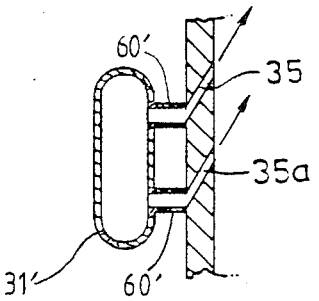
FIG. 4 is a section through a part of the molding frame and a compressed-air container connected therewith in a modified embodiment of the inventive foundry mold manufacturing apparatus shown in FIG. 3.

FIG. 4 illustrates a section of the upper part of the molding frame 3 containing further apertures or openings or passages 35 and 35a which are upwardly directed at an inclination and extend through the wall of the molding frame 3. These inclined further apertures or openings 35 and 35a communicate via related inflow conduits 60' with a further pressure-tight container or annular conduit 31' which extends around the upper portion of the molding frame 3. The further pressure-tight container or annular conduit 31' may contain, in a compressed state, the same preselected gas as the pressure-tight container or annular conduit 31 which is operatively associated with the single-walled filling frame 4b in FIG. 3. This further pressure-tight container or annular conduit 31' may be connected in any conventional manner with a separate source of the compressed preselected gas or may be connected in any suitable conventional manner with the infeed means 29 shown for the embodiment of FIG. 3. The inclined upwardly directed further apertures or openings 35 and 35a produce associated predetermined local regions of reduced packing density in the foundry molding material or molding sand 16 which is contained in the upper portion of the molding frame 3.

Figure 5:
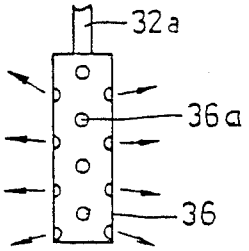
FIG. 5 is a side view of a compressed-air distributor for distributing compressed air within the foundry molding material for use with the third embodiment of the inventive foundry mold manufacturing apparatus shown in FIG. 3.

FIG. 5 shows differently structured deflecting means which can be used in combination with the blowing means 32 instead of the substantially cup-shaped deflecting means 33 which are shown in FIG. 3 and which produce a substantially cylindrical and substantially laterally directed expanding gas. Such modified deflecting means contain a hollow cylinder 36, and the further inflow conduit 32a opens into such hollow cylinder 36. The substantially cylindrical wall of the hollow cylinder 36 is provided with a multitude of outflow or discharge opening or ports 36a which mainly impart a lateral and outward direction to the flow of the expanding gas which is fed through the blowing means 32.

The aforedescribed constructions of the inventive foundry mold manufacturing apparatus are each provided with means for producing the predetermined local regions or zones 24, 24a and 24b, as the case may be, in combination with compacting means constituting the compressed-air surge compacting means 70. However, the same means for producing such local regions of reduced packing density, according to the invention, as previously mentioned, can also be used in combination with other types of such apparatus containing, for example, vibrational compacting means or blast compression means. Powerful surges of compressed air which are applied during the compacting operation to the foundry molding material or molding sand 16 have been found to result in a significant homogenization of the qualities or properties of the mold, i.e. its mold packing. This will be described hereinbelow with reference to a fourth embodiment of the inventive foundry mold manufacturing apparatus illustrated in FIG. 6.

Figure 6:
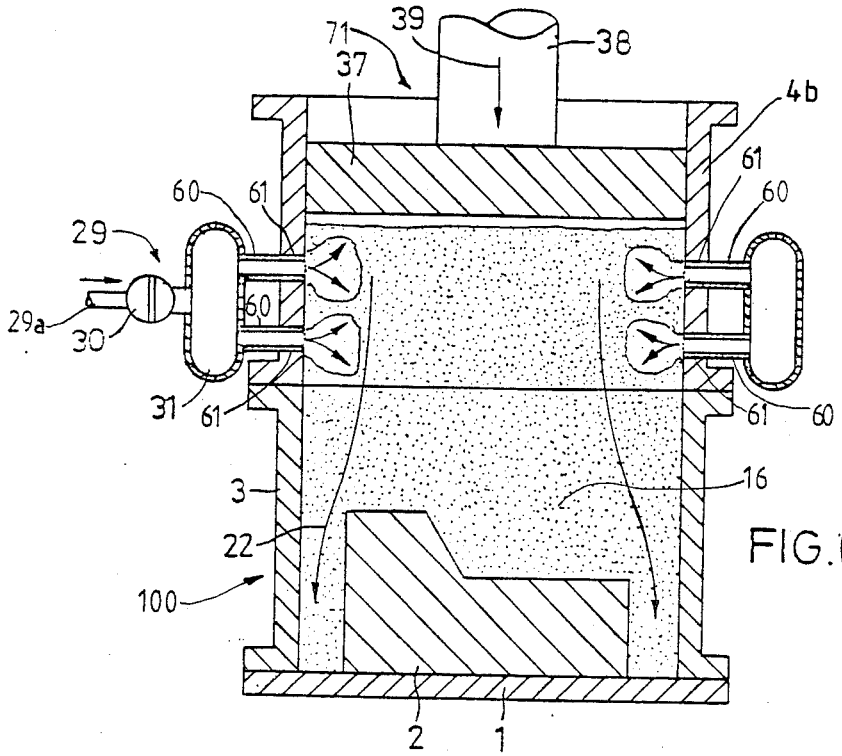
FIG. 6 is a schematic vertical section through a fourth embodiment of the inventive foundry mold manufacturing apparatus.

As shown in such FIG. 6, the mold frame means 100 contain a molding frame 3 which is closed at one end by a pattern plate 1 which supports at least one mold pattern 2. A single-walled filling frame 4b bears upon the opposite end of the molding frame 3. A major portion of the single-walled filling frame 4b and the molding frame 3 are filled by a suitable foundry molding material which is constituted by molding sand 16 in the illustrated embodiment. The single-walled filling frame 4b is traversed by a predetermined number of apertures or openings 61 which are connected with gas infeed means 29 for infeeding a compressed preselected gas and such gas infeed means 29 substantially correspond to the gas infeed means 29 described hereinbefore with reference to FIG. 3. The gas infeed means 29 thus comprise an infeed conduit 29a which is connected through a quick or rapid-operating valve 30 with a pressure-tight container or annular conduit 31 which extends around the single-walled filling frame 4b and which, in turn, communicates with the apertures or openings 61 by means of related inflow conduits 60. Predetermined local regions 24b of reduced sand packing density are formed during the compacting operation in the molding sand 16 when the compressed preselected gas is infed by the infeed means 29 and expands within the molding sand 16 received in the single-walled filling frame 4b.

The mold frame means 100 illustrated in FIG. 6 are provided at the end of the single-walled filling frame 4b which is remote from the molding frame 3, with pressure compacting means 71 containing a pressing plate 37. A piston rod 38 is operatively associated with the pressing plate 37 and presses such pressing plate 37 downwardly in the direction of the arrow 39 against the molding sand 16 which is located in the interior spaces of the single-walled filling frame 4b and the molding frame 3. Due to such pressing action the sand compaction is thus achieved in a mechanical manner.

In the embodiment illustrated in FIG. 6 the pressure-tight chamber or annular conduit 31 contains a combustible gas which is directed into the molding sand 16 through the inflow conduits 60 and the apertures or openings 61 which traverse the single-walled filling frame 4b. Suitable, conventional ignition means for triggering combustion of the combustible gas are arranged in such a manner that the combustible gas is ignited within the molding sand 16. If desired, conventionally structured check valves can be provided to prevent a backflow of the combustible gas or combustion gases through the apertures or openings 61 into the inflow conduits 60.

The combustible gas can be selected in any appropriate manner in correspondence with momentary requirements. Suitable combustible gases are, for example, natural gas-air mixtures or natural gas-oxygen mixtures, acetylene-air mixtures or acetylene-oxygen mixtures, and gasoline-air mixtures or gasoline-oxygen mixtures.

Figure 7:
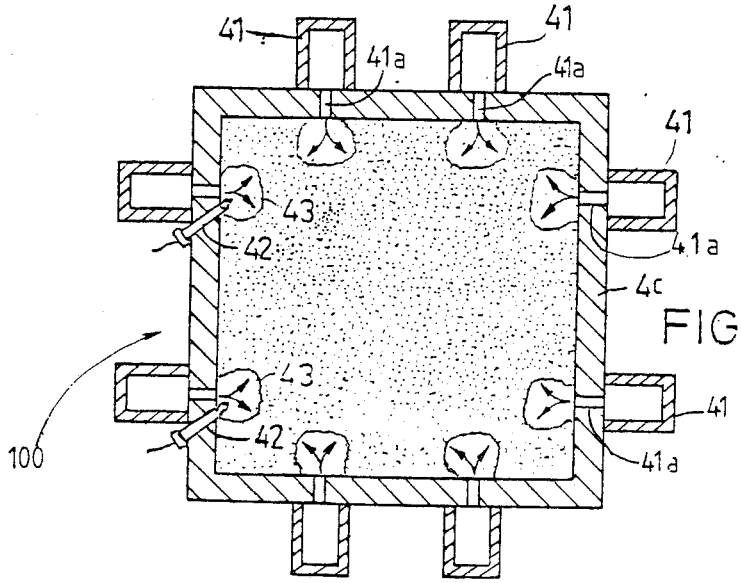
FIG. 7 is a schematic horizontal section through a filling frame provided with combustible gas containers in a fifth embodiment of the inventive foundry mold manufacturing apparatus.

A fifth embodiment of the inventive foundry mold manufacturing apparatus as illustrated in FIG. 7 shows differently structured means for infeeding the expanding gas into the foundry molding material, specifically the molding sand 16 which is present in a single-walled filling frame 4c. FIG. 7 shows a horizontal section through mold frame means 100 in a plane intersecting such differently constructed gas infeeding means. The other parts of the mold frame means 100 are constructed analogously to the embodiments described hereinbefore with reference to FIGS. 1 to 3 as well as FIGS. 5 and 6.

In this specific embodiment under discussion the gas infeed means for the preselected gas contain a plurality of pressure-tight, substantially cylindrical containers or chambers 41 which are distributed around the circumference of the quadrangular single-walled filling frame 4c. The pressure-tight substantially cylindrical containers or chambers 41 communicate with the interior of the single-walled filling frame 4c through related apertures or openings 41a which traverse the single-walled filling frame 4c. The preselected gas can be infed into the pressure-tight, substantially cylindrical chambers 41 in any appropriate conventional manner and such preselected gas can be infed and expanded into the foundry molding material or molding sand 16 in different ways. In the case that the preselected gas contained in the pressure-tight substantially cylindrical chambers 41 constitutes a combustible gas, such gas can be ignited by suitably selected, conventional igniting means and thereafter the combustion gas or combustion gas mixture is infed into and expanded in the foundry molding material or molding sand 16 through the apertures or openings 41a which traverse or pierce through the single-walled filling frame 4c. In this manner there are produced a predetermined number of local regions 43 of reduced packing density of the foundry molding material or molding sand 16 during a sand compacting operation. Such sand compacting operation can be carried out using any one of the previously described or mentioned compacting means, such as the compressed-air surge compacting means 70 or the pressure compacting means 71.

Alternatively, the combustible gas may be allowed to enter the foundry molding material or molding sand 16 through the apertures or openings 41a and there can be provided ignition means like conventional ignition plugs 42 on the inside of the single-walled filling frame 4c. In this manner, there are also produced the aforementioned predetermined local regions 43 of reduced sand packing density.

Depending upon the type of the combustible gas or gas mixture used, the manner of gas infeeding and the concentration of the combustible gas or gas mixture, and upon the moment of ignition of such combustible gas or gas mixture there is governed or determined the loose or loosely packed condition or state of the foundry molding material or molding sand 16 in the proximal region of the single-walled filling frame 4c. Specifically and under appropriate conditions the regions 43 of reduced sand packing density may form pronounced voids or cavities under the action of the expanding preselected gas or combustion gas or combustion gas mixture. As a result of the formation of such voids or cavities the foundry molding material or molding sand 16 is conveyed or transported and subjected to pre-compaction.

The use of the pressure compacting means 71 illustrated in FIG. 6 or the use of vibrational compacting means or combined pressure-and-vibrational compacting means in many cases has the advantage that the sand compacting operation requires a certain time duration of, for example, a number of seconds. Correspondingly the loose or loosely packed condition can be maintained during the sand compacting operation and thus also for a number of seconds so that the generation of such loose or loosely packed condition can be more easily controlled.

Figure 8:
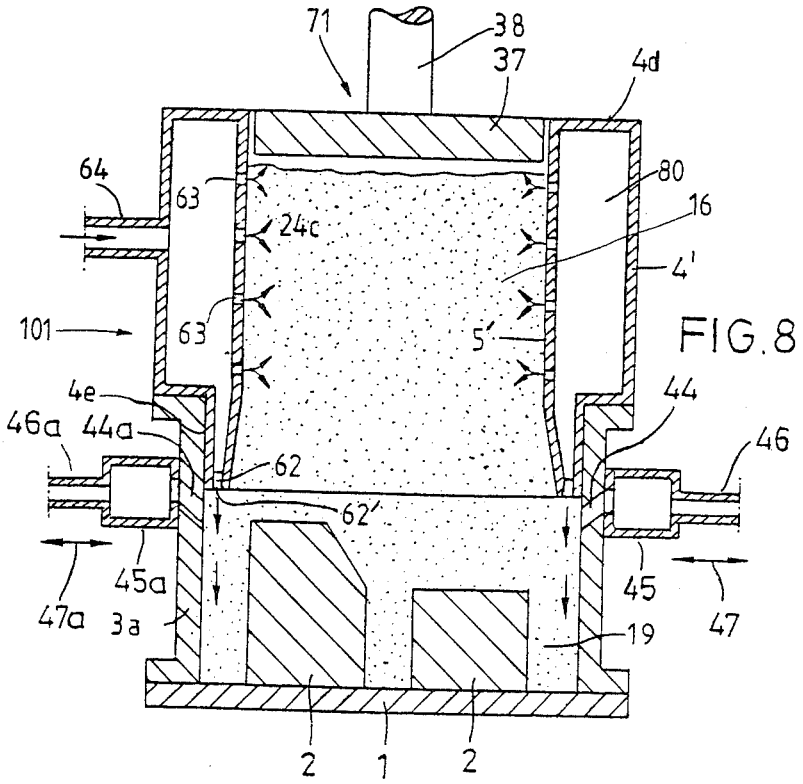
FIG. 8 is a schematic vertical section through a sixth embodiment of the inventive foundry mold manufacturing apparatus.

A sixth embodiment of the inventive foundry mold manufacturing apparatus is illustrated in FIG. 8 and such embodiment is provided in connection with mold frame means 101 containing a molding frame 3a which is closed at one end by a pattern plate 1 which supports a number of mold patterns 2, two of which are visible in FIG. 8. The mold frame means 101 further contains a double-walled filling frame 4d at the end of the molding frame 3a which is remote from the pattern plate 1. Such filling frame 4d is formed as a double-walled structure at least in the lower region thereof facing the molding frame 3a. The filling frame 4d, however, may also contain, as illustrated, a double-walled structure which extends over the entire height of such filling frame 4d. The double-walled structure contains an external wall 4' and an internal frame or wall 5' with an intermediate space or passage 80 therebetween defining an annular gas pressure chamber. The external wall 4' of the double-walled filling frame 4d is provided with a gas supply or infeed connection 64 through which the preselected gas is supplied to the intermediate space or passage 80 constituting the annular gas pressure chamber of the double-walled filling frame 4d. As previously stated, the double-walled filling frame 4d is mounted at the end of the molding frame 3a which is remote from the pattern plate 1. In this particular embodiment a substantially wedge-shaped lower region 4e of the double-walled filling frame 4d, in other words the lower region of the intermediate space 80 defining the pressure chamber extends into the interior space of the molding frame 3a. In such wedge-shaped lower region 4e there are provided downwardly directed channels 62 at the internal wall 5' and which contain downwardly directed discharge or outflow openings or ports 62' which are directed into the interior space or into the foundry molding material or molding sand 16 which is contained in the molding frame 3a and thus allow the exertion of downwardly directed gas pressure pulses upon the molding sand 16. A plurality of apertures or openings 63 traverse the internal frame or wall 5' of the double-walled filling frame 4d and thereby the internal frame or wall 5' may assume a perforated or screen-like configuration.

The mold frame means 101 is provided at the end of the double-walled filling frame 4d which is remote from the molding frame 3a, with pressure compacting means 71 which may correspond to the pressure compacting means 71 described hereinbefore with reference to FIG. 6. During the compacting operation, as described hereinbefore, a compressed preselected gas is supplied to the intermediate space or annular gas pressure chamber 80 in the double-walled filling frame 4d through the supply connection 64. The compressed preselected gas is further infed and expands into the foundry molding material or molding sand 16 which is contained in the interior space of the double-walled filling frame 4d, through the apertures or openings 63 whereby a predetermined number of local regions 24c of reduced sand packing density are produced. At the same time this compressed preselected gas is supplied through the discharge or outflow openings or ports 62' into the foundry molding material or molding sand 16 in the molding frame 3a.

Thus also in this construction there is imparted a predetermined inflow direction to the preselected gas which is infed and expanded into the foundry molding material or molding sand 16 in such a manner that there is favored a direction of movement of the foundry molding material or molding sand 16 in correspondence with difficulties which are encountered due to the pattern arrangement or array upon the pattern plate 1. Thus, the discharge or outflow openings or ports 62' are directed from the intermediate space or pressure chamber 80 and the lower situated channels 62 towards the intermediate space or spaces which exist between the mold patterns 2 and the wall of the molding frame 3a.

The apertures or openings 63 which traverse the internal frame or wall 5' of the double-walled filling frame 4d particularly favorably affect the pressing operation exerted upon the foundry molding material or molding sand 16 under the action of the pressure compacting means 71 or the pressure plate 37 because the foundry molding material or molding sand 16 assumes a relatively low packing density under the action of the expanding preselected gas, and thus, the particles or grains of such foundry molding material or molding sand 16 are converted into a correspondingly easy-flowing state or highly fluent condition.

This sixth embodiment of the inventive foundry mold manufacturing apparatus which is illustrated in FIG. 8 is further provided with gas infeed means for infeeding and expanding a preselected gas into the foundry molding material or molding sand 16 which is present in the interior space of the molding frame 3a. Specifically, such further gas infeed means contain pressure-tight containers or chambers constituting hollow ledges 45 and 45a or other suitable structure which are connected with a suitable source of the compressed preselected gas by means of related hollow rams 46 and 46a. The molding frame 3a is provided with downwardly inclined apertures or openings 44 and 44a. During operation, the pressure-tight containers or chambers or hollow ledges 45 and 45a are displaced in the related directions 47 and 47a under the action of not particularly illustrated conventionally controlled and constructed drive means which act upon the related hollow rams 46 and 46a. When the pressure-tight containers or chambers or hollow ledges 45 and 45a contact the outer surface of the molding frame 3a, the interior spaces of such pressure-tight containers or chambers or hollow ledges 45 and 45a flow communicate with the related downwardly inclined apertures or openings 44 and 44a which traverse the wall of the molding frame 3a.

Therefore, downwardly directed compressed gas surges are produced during the time that the pressure-tight containers or chambers or hollow ledges 45 and 45a flow communicate with the related apertures or openings 44 and 44a which traverse the wall of the molding frame 3a. Such compressed gas surges are directed or guided into the intermediate space or gap which exists between the mold patterns 2 and the inner wall of the molding frame 3a. The compressed gas surges can be selected such that the sliding capacity of the foundry molding material or molding sand 16 is markedly improved. However, the compressed gas surges can also be selected such that these compressed gas surges convey or transport the foundry molding material or molding sand 16 and produce a pre-compaction simultaneously therewith. As a result, there is achieved, in addition to the action of the pressure compacting means 71 which act upon the foundry molding material or molding sand 16 from above and from the exterior, an additional sand transport or displacement and simultaneously therewith a pre-compaction of the foundry molding material or molding sand 16 in the proximal region of the mold patterns 2 at difficultly accessible or critical molding or packing regions 19. It may be noted also at this place that such sand pre-compaction close to the mold patterns 2 is terminated before the final compacting pressure exerted by the pressure compacting means 71 is fully reached or prior to the termination of the sand compacting operation.

As noted already hereinbefore, the lower region 4e of the double-walled filling frame 4d protrudes, specifically in a wedge-like manner, into the molding frame 3a, see FIG. 8. After completion of the manufacture of the sand mold and after removal of the double-walled filling frame 4d there thus remains a wedge-shaped gap at the inner wall in the upper region of the molding frame 3a. This wedge-shaped gap is without disadvantage for the casting or sand mold. In fact, such wedge-shaped gap even has the advantage that the gases which are formed during or after the casting operation, can more easily vent from the mold sand.

Figure 9:
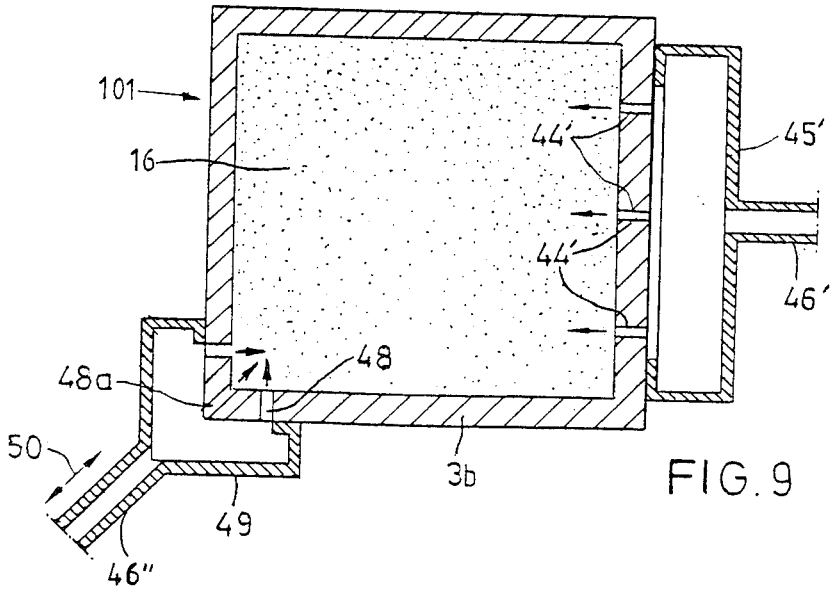
FIG. 9 is a horizontal section through a molding frame and an associated compressed-air conduit in a seventh embodiment of the inventive foundry mold manufacturing apparatus.

FIG. 9 shows a horizontal section through a seventh embodiment of the inventive foundry mold manufacturing apparatus, particularly through a molding frame 3b thereof. Otherwise the mold frame means 101 of this embodiment are constructed in the manner as illustrated in FIG. 8 for instance, or for that matter like in FIGS. 1, 2, 3, 6 and 7 for example. There is provided on one side of the molding frame 3b a pressure-tight container or chamber 45' which is connected with a suitable source of a compressed preselected gas by means of a conduit 46'. The pressure-tight container or chamber 45' communicates with the interior space of the molding frame 3b through apertures or openings 44' which traverse the wall of the molding frame 3b in the region of the pressure-tight container or chamber 45'.

Additionally, there is provided in one corner region of the molding frame 3b an angled pressure-tight container or chamber constituting an angled hollow ledge 49 which is supplied with a compressed preselected gas through a hollow ram 46''. The angled pressure-tight container or chamber or angled hollow ledge 49 can be reciprocated to and away from the wall of the molding frame 3b under the action of conventionally controlled and constructed drive means, as generally indicated by the double-headed arrow 50. Apertures or openings 48 traverse the wall of such molding frame 3b in the aforementioned corner region of the molding frame 3b. When the angled pressure-tight container or chamber or angled hollow ledge 49 contacts the outer wall of the molding frame 3b, the interior space thereof flow communicates with the apertures or openings 48 and the compressed preselected gas is infed into and expanded in the foundry molding material or molding sand 16 which is present in the corner region of the molding frame 3b. This is particularly favorable because the transport or displacement of the foundry molding material or molding sand 16 in the corner regions of the molding frame is very difficult when utilizing hitherto known types of sand compacting operations and apparatus.

Figure 10:
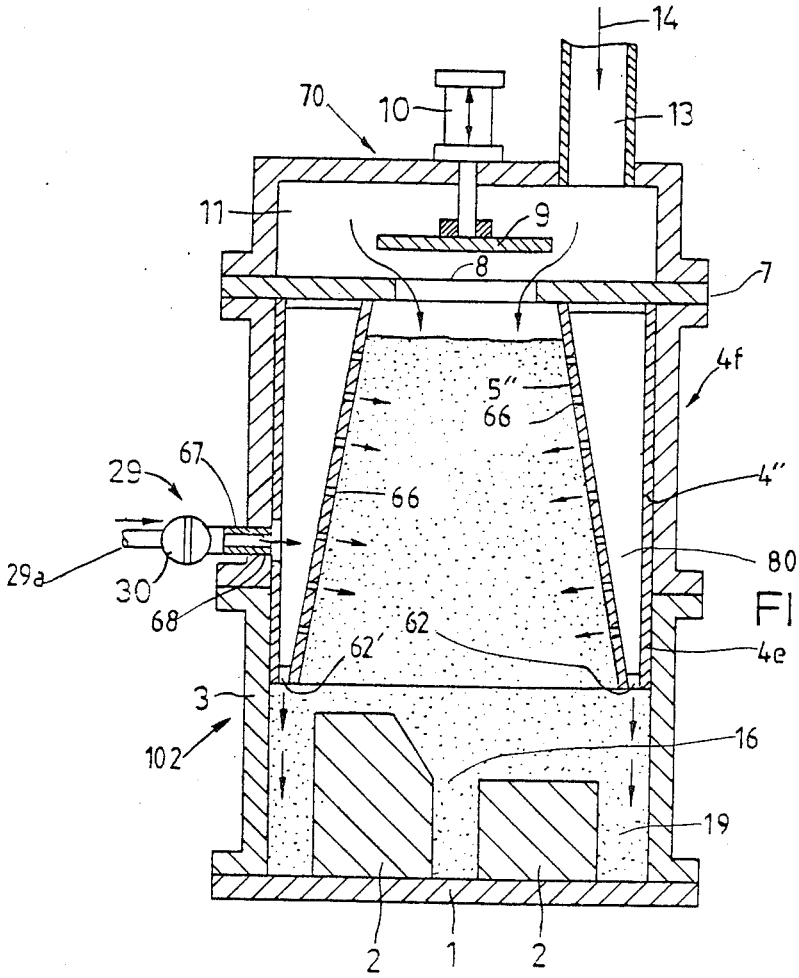
FIG. 10 is a schematic vertical section through an eighth embodiment of the inventive foundry mold manufacturing apparatus.

The eighth embodiment of the inventive foundry mold manufacturing apparatus as illustrated in FIG. 10 again contains a molding frame 3 which is covered at one end by a pattern plate 1 which supports a number of mold patterns 2, two of which can be recognized in the drawing. A double-walled filling frame **4*f* bears upon the opposite end of the molding frame 3. At the end remote from the molding frame 3, the double-walled filling frame 4*f* is provided with compressed-air surge compacting means 70 of the type as described hereinbefore with reference to FIGS. 1 and 2**.

The double-walled filling frame **4*f* contains a lower region 4*e* which extends into the upper region of the interior space of the molding frame 3 similar to the manner described with reference to the double-walled filling frame 4*d* illustrated in FIG. 8. This double-walled filling frame 4*f* contains an external wall 4″ and an internal frame or wall 5″ and these two walls bound an interior space or passage 80 defining an annular pressure chamber. The external wall 4″ of the double-walled filling frame 4*f* contains an opening 68 which flow communicates through an inflow conduit 67 with gas infeed means 29 containing a quick or rapid-operating valve 30 for infeeding a compressed preselected gas into the intermediate space or passage 80. The internal frame or wall 5″ contains a plurality of apertures or openings 66 and thereby the internal frame or wall 5″** may assume a perforated or screen-like structure.

Much in the manner as illustrated in FIG. 8, the lower region **4*e* of the double-walled filling frame 4*f* contains downwardly extending or directed channels 62 equipped with downwardly oriented discharge or outflow openings or ports 62′ which are directed into the foundry molding material or molding sand 16 contained in the interior space of the molding frame 3. As already explained hereinbefore with reference to FIG. 8, such arrangement favorably affects the compaction of the foundry molding material or molding sand 16 in the critical molding or packing regions 19 between the mold patterns 2 and the inner wall of the molding frame 3**.

The internal frame or wall 5″ of the double-walled filling frame **4*f* assumes a substantially conical or truncated conical configuration and expands or widens in a direction from the pressure chamber 11 of the compressed air surge compacting means 70 towards the molding frame 3. During the compacting operation upon the foundry molding material or molding sand 16 under the action of the compressed-air surge compacting means 70, the foundry molding material or molding sand 16 not only is converted into a more loosely packed state or condition due to the infeed and expansion of the compressed preselected gas through the apertures or openings 66, but additionally this more loosely packed state of the molding sand 16 is also due to the widening of the mold space or interior space of the double-walled filling frame 4*f*. This additional loosening of the molding sand 16 occurs during the migration of the foundry molding material or molding sand 16 from the double-walled filling frame 4*f* into the molding frame 3. It has been found particularly advantageous that the reduction in the packing density of the foundry molding material or molding sand 16 during the compacting operation for manufacturing or forming the foundry or casting mold is obtained by the aforementioned widening or expansion of the mold space or interior space of the double-walled filling frame 4*f* simultaneous with the action of the compressed preselected gas which is infed into and expanded in the foundry molding material or molding sand 16 through the apertures or openings 66**.

While there are shown and described present preferred embodiments of the invention, it is to be distinctly understood that the invention is not limited thereto, but may be otherwise variously embodied and practiced within the scope of the following claims. Accordingly,

What I claim is:

1. A method of manufacturing a foundry mold, especially for compacting foundry molding material, comprising the steps of:

infeeding a preselected foundry molding material into mold frame means containing a molding frame which defines an interior space and which is provided with pattern means supporting at least one mold pattern, and further containing a filling frame defining an interior space, in order to thereby fill a remaining portion of the interior space of the molding frame which is not filled by the at least one mold pattern and a predetermined portion of the interior space of said filling frame with such preselected foundry molding material;

compacting said foundry molding material infed into said mold frame means in order to thereby displace a predetermined portion of said foundry molding material present in said filling frame from said filling frame into said molding frame in order to thereby form the foundry mold;

during said step of compacting said foundry molding material, infeeding into and expanding a preselected gas in predetermined local regions of said foundry molding material during the time such foundry molding material is being compacted in order to thereby produce said predetermined local regions which possess a reduced packing density of said foundry molding material; and after the step of infeeding and expanding said preselected gas and during the course of said compacting operation, essentially eliminating said predetermined local regions of reduced packing density and which predetermined local regions are formed as a result of infeeding and expanding said preselected gas; and during said step of eliminating said predetermined local regions of reduced packing density, increasing the packing density of said predetermined local regions essentially to a packing density prevailing in remaining regions of said foundry molding material.

2. The method as defined in claim 1, wherein:

said step of infeeding said foundry molding material into said mold frame means entails the step of pouring said foundry molding material into said mold frame means.

3. The method as defined in claim 1, wherein:

said step of infeeding said foundry molding material into said mold frame means entails the step of pneumatically infeeding said foundry molding material into said mold frame means.

4. The method as defined in claim 1, wherein:

during said step of compacting said infed foundry molding material infed into said mold frame means, using compressed-air surge compacting for compacting said foundry molding material infed into said mold frame means.

5. The method as defined in claim 1, wherein:

during said step of compacting said infed foundry molding material infed into said mold frame means, using combustion-force surge compacting for compacting said foundry molding material infed into said mold frame means.

6. The method as defined in claim 1, wherein:

during said step of compacting said infed foundry molding material infed into said mold frame means, using pressure compacting for compacting said foundry molding material infed into said mold frame means.

7. The method as defined in claim 1, wherein:

during said step of compacting said infed foundry molding material infed into said mold frame means, using vibrational compacting for compacting said foundry molding material infed into said mold frame means.

8. The method as defined in claim 1, wherein:

during said step of compacting said infed foundry molding material infed into said mold frame means, using combined pressure-and-vibrational compacting for compacting said foundry molding material infed into said mold frame means.

9. The method as defined in claim 1, wherein:

said step of infeeding into and expanding said preselected gas in said predetermined local regions of said foundry molding material entails infeeding said gas and subsequently expanding said infed gas in said predetermined local regions of said foundry molding material.

10. The method as defined in claim 9, wherein:

said step of infeeding said preselected gas into said predetermined local regions of said foundry molding material entails infeeding a combustible gas mixture into said predetermined local regions of said foundry molding material; and said step of subsequently expanding said infed combustible gas mixture entails igniting said infed combustible gas mixture and thereby forming an expanding combustion gas.

11. The method as defined in claim 10, further including the step of:

selecting said combustible gas mixture from the group consisting of natural gas-air mixture, natural gas-oxygen mixture, acetylene-air mixture, acetylene-oxygen mixture, gasoline-air mixture, and gasoline-oxygen mixture.

12. The method as defined in claim 1, wherein:

said step of infeeding into and expanding said preselected gas in said predetermined local regions of said foundry molding material entails infeeding said preselected gas and expanding said preselected gas while infeeding the same.

13. The method as defined in claim 12, wherein:

said step of infeeding said preselected gas and expanding said preselected gas while infeeding the same entails using compressed air as said preselected gas.

14. The method as defined in claim 12, further including the steps of:

subjecting a combustible gas mixture to combustion and thereby producing a combustion gas; and during said step of infeeding said preselected gas and expanding said preselected gas while infeeding the same into said predetermined local regions of said foundry molding material, using said combustion gas as said preselected gas.

15. The method as defined in claim 14, further including the step of:

selecting said combustible gas mixture from the group consisting of natural gas-air mixture, natural gas-oxygen mixture, acetylene-air mixture, acetylene-oxygen mixture, gasoline-air mixture, and gasoline-oxygen mixture.

16. The method as defined in claim 14, further including the steps of:

infeeding said combustible gas mixture into at least one pressure-tight container connected with the interior space of said filling frame;

said step of subjecting said combustible gas mixture to combustion entailing the step of igniting said infed combustible gas mixture in said at least one pressure-tight container; and said step of infeeding said preselected gas and expanding said preselected gas while infeeding the same, entailing the step of infeeding said combustion gas into said predetermined local regions of said foundry molding material filling at least said predetermined portion of the interior space of said filling frame.

17. The method as defined in claim 14, further including the steps of:

infeeding said combustible gas mixture into at least one pressure-tight container connected with the interior space of said molding frame;

said step of subjecting said combustible gas mixture to combustion entailing the step of igniting said infed combustible gas mixture in said at least one pressure-tight container; and said step of infeeding said preselected gas and expanding said preselected gas while infeeding the same, entailing the step of infeeding said combustion gas into said predetermined local regions of said foundry molding material filling said remaining portion of the interior space of the molding frame.

18. The method as defined in claim 14, further including the steps of:

infeeding said combustible gas mixture into at least one pressure-tight container connected with the interior space of said filling frame;

infeeding said combustible gas mixture into at least one pressure-tight container connected with the interior space of said molding frame;

said step of subjecting said combustible gas mixture entailing the steps of igniting said infed combustible gas mixtures in said at least one pressure-tight containers which are respectively connected with said interior spaces of said filling frame and of said molding frame; and said step of infeeding said preselected gas and expanding said preselected gas while infeeding the same, entailing the step of infeeding said combustion gas into said predetermined local regions of said foundry molding material filling at least said predetermined portion of the interior space of said filling frame and said remaining portion of the interior space of said molding frame.

19. The method as defined in claim 1, wherein:

said step of eliminating said predetermined local regions of reduced packing density and increasing the packing density of said predetermined local regions essentially to the packing density prevailing in the remaining regions of said foundry molding material entails essentially eliminating said reduced packing density and increasing the packing density of said predetermined local regions substantially at the end of said compacting operation.

20. The method as defined in claim 1, wherein:
during said step of infeeding into and expanding said preselected gas in said predetermined local regions of said foundry molding material, producing zones which contain gas occlusions and which have a strength exceeding the strength of adjacent regions.

21. The method as defined in claim 1, wherein:
during said step of infeeding into and expanding said preselected gas in said predetermined local regions of said foundry molding material, producing in said predetermined local regions zones containing distinct cavities; and
conveying and pre-compacting said foundry molding material in said predetermined local regions as a result of the production of said cavities.

22. The method as defined in claim 1, wherein:
said step of infeeding and expanding said preselected gas includes the step of imparting to said expanding preselected gas a predetermined inflow direction in order to thereby initiate a predetermined direction of movement of said foundry molding material in correspondence with difficulties encountered due to the arrangement of the at least one mold pattern in said molding frame.

23. The method as defined in claim 1, further including the steps of:
arranging said at least one mold pattern in said molding frame and thereby forming predetermined intermediate spaces between said at least one mold pattern and said molding frame; and
said step of infeeding into and expanding said preselected gas in said predetermined local regions of said foundry molding material in order to thereby produce said predetermined local regions of reduced packing density, including the step of predominantly producing said predetermined local regions of reduced packing density of said foundry molding material substantially above said predetermined intermediate spaces between said at least one mold pattern and said molding frame.

24. The method as defined in claim 1, further including the steps of:
arranging a predetermined number of mold patterns constituting said at least one mold pattern in said molding frame and thereby forming a predetermined number of intermediate spaces between said predetermined number of mold patterns; and
said step of infeeding into and expanding said preselected gas in said predetermined local regions of said foundry molding material in order to thereby produce said predetermined local regions of reduced packing density, including the step of predominantly producing said predetermined local regions of reduced packing density of said foundry molding material substantially above said predetermined intermediate spaces formed between said predetermined number of mold patterns.

25. The method as defined in claim 1, further including the steps of:
arranging in said molding frame at least one mold pattern containing at least one pronounced indentation; and
said step of infeeding into and expanding said preselected gas in said predetermined local regions of said foundry molding material in order to thereby produce said predetermined local regions of reduced packing density, including the step of predominantly producing said predetermined local regions of reduced packing density of said foundry molding material substantially above said at least one pronounced indentation contained in said at least one mold pattern.

26. An apparatus for manufacturing a foundry mold, especially for compacting foundry molding material, comprising:
a pattern plate;
at least one mold pattern mounted on the pattern plate;
a molding frame surrounding the at least one mold pattern and defining an interior space partially filled by the at least one mold pattern and for receiving foundry molding material;
a filling frame mounted on top of the molding frame and defining an interior space for receiving the foundry molding material;
said filling frame containing at least one aperture associated with at least one predetermined lateral local region of said foundry molding material contained in said filling frame;
compacting means arranged on top of the filling frame for compacting the foundry molding material;
said pattern plate, said at least one mold pattern, said molding frame, said filling frame and said compacting means conjointly constituting mold frame means; and
said mold frame means containing in said filling frame said at least one aperture and means for infeeding into and expanding a preselected gas only in said predetermined lateral local regions of said foundry molding material in order to thereby transiently produce said predetermined local regions which possess reduced packing density of said foundry molding material during operation of said compacting means.

27. The apparatus as defined in claim 26, wherein:
said molding frame contains said at least one aperture for infeeding into and expanding said preselected gas in said predetermined local regions of said foundry molding material contained in said molding frame.

28. An apparatus for manufacturing a foundry mold, especially for compacting foundry molding material, comprising:
a pattern plate;
at least one mold pattern mounted on the pattern plate;
a molding frame surrounding the at least one mold pattern and defining an interior space partially filled by the at least one mold pattern and for receiving foundry molding material;
a filling frame mounted on top of the molding frame and defining an interior space for receiving the foundry molding material;
compacting means arranged on top of the filling frame for compacting the foundry molding material;
said pattern plate, said at least one mold pattern, said molding frame, said filling frame and said compacting means conjointly constituting mold frame means;
said mold frame means containing at least one aperture for infeeding into and expanding a preselected gas in predetermined local regions of said foundry molding material in order to thereby transiently produce said predetermined local regions which possess reduced packing density in said foundry molding material during operation of said compacting means;

said filling frame containing an internal frame;

said filling frame defining an inner surface;

said internal frame possessing an outer surface spaced from said inner surface of said filling frame and forming therebetween a gas passage;

said internal frame bounding the interior space of said filling frame; and said internal frame containing said at least one aperture for infeeding into and expanding said preselected gas in said predetermined local regions of said foundry molding material during operation of said compacting means.

29. The apparatus as defined in claim 28, wherein:

said internal frame is provided with a perforated configuration of apertures constituting said at least one aperture.

30. The apparatus as defined in claim 28, wherein:

said internal frame contains a bottom side provided with a substantially circumferentially extending aperture constituting said at least one aperture;

said internal frame further containing at its bottom side deflecting means; and said deflecting means substantially upwardly deflecting said infed and expanding preselected gas within said foundry molding material filling said predetermined portion of the interior space bounded by said internal frame during operation of said compacting means.

31. The apparatus as defined in claim 28, wherein:

said compacting means constitute compressed-gas surge compacting means;

said compressed-gas surge compacting means containing compressed-gas surge passage means; and said compressed-gas surge passage means being connected to said gas passage formed between said outer surface of said internal frame and said inner surface of said filling frame during operation of said compressed-gas surge compacting means.

32. The apparatus as defined in claim 31, wherein:

said compacting means constitutes a compressed-air surge compacting means.

33. The apparatus as defined in claim 28, wherein:

said compacting means constitute combustion-force surge compacting means;

said combustion-force surge compacting means containing passage means; and said passage means being connected to said gas passage formed between said outer surface of said internal frame and said inner surface of said filling frame during operation of said combustion-force surge compacting means.

34. An apparatus for manufacturing a foundry mold, especially for compacting foundry molding material, comprising:

a pattern plate;

at least one mold pattern mounted on the pattern plate;

a molding frame surrounding the at least one mold pattern and defining an interior space partially filled by the at least one mold pattern and for receiving foundry molding material;

a filling frame mounted on top of the molding frame and defining an interior space for receiving the foundry molding material;

compacting means arranged on top of the filling frame for compacting the foundry molding material;

said pattern plate, said at least one mold pattern, said molding frame, said filling frame and said compacting means conjointly constituting mold frame means;

said mold frame means containing at least one aperture for infeeding into and expanding a preselected gas in predetermined local regions of said foundry molding material in order to thereby transiently produce said predetermined local regions which possess reduced packing density in said foundry molding material during operation of said compacting means;

at least one pressure-tight container housing said preselected gas; and a predetermined number of inflow conduits interconnecting said at least one pressure-tight container and said at least one aperture in said mold frame means.

35. The apparatus as defined in claim 34, wherein:

said at least one pressure-tight container is arranged at said filling frame; and said predetermined number of inflow conduits being directed towards the interior space of said filling frame in the region of said foundry molding material during operation of said mold frame means.

36. The apparatus as defined in claim 35, further including:

pressure means;

said at least one aperture of said mold frame means defining a predetermined number of apertures in said filling frame;

means for operating said mold frame means in predetermined operating cycles; and said pressing means reciprocatingly pressing said at least one pressure-tight container against said filling frame in accordance with predetermined operating cycles of the mold frame means and such that an interconnection is provided between said predetermined number of inflow conduits extending from said at least one pressure-tight container and related ones of said predetermined number of apertures in said filling frame.

37. The apparatus as defined in claim 36, wherein:

said filling frame possesses a predetermined height; and said filling frame containing said predetermined number of apertures at different levels of said predetermined height of said filling frame.

38. The apparatus as defined in claim 34, wherein:

said at least one pressure-tight container is arranged at said molding frame; and said predetermined number of inflow conduits being directed towards the interior space of said molding frame in the region of said foundry molding material during operation of said mold frame means.

39. The apparatus as defined in claim 38, further including:

pressing means;

said at least one aperture of said mold frame means defining a predetermined number of apertures in said molding frame;

means for operating said mold frame means in predetermined operating cycles; and said pressing means reciprocatingly pressing said at least one pressure-tight container against said molding frame in accordance with predetermined operating cyles of the mold frame means and such that an interconnection is provided between said predetermined number of inflow conduits extending from said at least one pressure-tight container and related ones of said predetermined number of apertures in said molding frame.

40. The apparatus as defined in claim 39, wherein:

said molding frame possesses a predetermined height; and said molding frame containing said predetermined number of apertures at different levels of said predetermined height of said molding frame.

41. The apparatus as defined in claim 34, wherein:

said at least one pressure-tight container constitutes at least two pressure-tight containers;

at least one of said at least two pressure-tight containers being arranged at said filling frame;

at least one other of said at least two pressure-tight containers being arranged at said molding frame; and said predetermined number of inflow conduits being respectively directed towards the interior spaces of said filling frame and of said molding frame in the regions of said foundry molding material during operation of said mold frame means.

42. The apparatus as defined in claim 41, further including:

pressing means;

said at least one aperture of said mold frame means defining a predetermined number of apertures in said filling frame and in said molding frame;

means for operating said mold frame means in predetermined operating cycles;

said pressing means reciprocatingly pressing said at least one pressure-tight container against said filling frame in accordance with predetermined operating cycles of the mold frame means and such that an interconnection is provided between said predetermined number of inflow conduits extending from said at least one pressure-tight container and related ones of said predetermined number of apertures in said filling frame; and further pressing means for reciprocatingly pressing said at least one other pressure-tight container against said molding frame in accordance with predetermined operating cycles of the mold frame means and such that an interconnection is provided between said predetermined number of inflow conduits extending from said at least one pressure-tight container and related ones of said predetermined number of apertures in said molding frame.

43. The apparatus as defined in claim 42, wherein:

each one of said filling frame and said molding frame possesses a predetermined height;

said filling frame containing said predetermined number of apertures at different levels of said predetermined height of said filling frame; and said molding frame containing said preselected number of apertures at different levels of said predetermined height of said molding frame.

44. The apparatus as defined in claim 34, further including:

at least one further inflow conduit extending from said at least one pressure-tight container housing said preselected gas;

said filling frame defining a top region;

said at least one further inflow conduit extending from said at least one pressure-tight container into said top region of said filling frame and from said top region of said filling frame into the interior space of said filling frame in the region of said foundry molding material during operation of said mold frame means; and said at least one further inflow conduit containing a lower end region which possesses at least one outflow opening.

45. The apparatus as defined in claim 44, wherein:

said lower end region of said at least one further inflow conduit is located in a remaining portion of the interior space of said molding frame which is not filled by the at least one mold pattern in the region of said foundry molding material during operation of said mold frame means.

46. The apparatus as defined in claim 44, further including:

deflecting means;

said deflecting means being operatively associated with said at least one outflow opening at said lower end region of said at least one further inflow conduit; and said deflecting means laterally and outwardly deflecting said preselected gas flowing from said pressure-tight container through said at least one further inflow conduit through said at least one outflow opening during operation of said mold frame means.

47. The apparatus as defined in claim 46, wherein:

said deflecting means constitute hollow substantially cylindrically-shaped deflecting means defining a substantially cylindrical wall;

said substantially cylindrical wall being provided with a plurality of openings; and said at least one outflow opening at said lower end region of said at least one further inflow conduit opening into said hollow substantially cylindrically-shaped deflecting means.

48. The apparatus as defined in claim 44, further including:

deflecting means;

said deflecting means being operatively associated with said at least one outflow opening at said lower end region of said at least one further inflow conduit; and said deflecting means laterally and upwardly deflecting said preselected gas flowing from said pressure-tight container through said at least one further inflow conduit and said at least one outflow opening during operation of said mold frame means.

49. The apparatus as defined in claim 48, wherein:

said deflecting means constitute substantially cup-shaped deflecting means possessing an open top; and said at least one outflow opening at said lower end region of said at least one further inflow conduit opening into said substantially cup-shaped deflecting means.

50. An apparatus for manufacturing a foundry mold, especially for compacting foundry molding material, comprising:

a pattern plate;

at least one mold pattern mounted on the pattern plate;

a molding frame surrounding the at least one mold pattern and defining an interior space partially filled by the at least one mold pattern and for receiving foundry molding material;

a filling frame mounted on top of the molding frame and defining an interior space for receiving the foundry molding material;

compacting means arranged on top of the filling frame for compacting the foundry molding material;

said pattern plate, said at least one mold pattern, said molding frame, said filling frame and said compacting means conjointly constituting mold frame means;

said mold frame means containing at least one aperture for infeeding into and expanding a preselected gas in predetermined local regions of said foundry molding material in order to thereby transiently produce said predetermined local regions which possess reduced packing density in said foundry molding material during operation of said compacting means;

said filling frame containing a bottom region and an inner side in said bottom region;

gas pressure chamber means arranged at least at said bottom region and on said inner side of said filling frame and housing said preselected gas during operation of said mold frame means; and said gas pressure chamber means being provided with a predetermined number of downwardly directed outflow openings.

51. The apparatus as defined in claim 50, wherein:

said gas pressure chamber means arranged at least at said bottom region and on said inner side of said filling frame extend circumferentially of said filling frame.

52. The apparatus as defined in claim 50, wherein:

said gas pressure chamber means arranged at least at said bottom region and on said inner side of said filling frame and provided with said predetermined number of downwardly directed outflow openings, possess outflow openings which extend into said molding frame.

53. The apparatus as defined in claim 50, wherein:

said filling frame constitutes a double-walled filling frame which extends over a predetermined height and contains an internal frame possessing a predetermined height;

said internal frame containing said at least one aperture; and said at least one aperture being provided for infeeding into and expanding said preselected gas in said predetermined local regions of said foundry molding material received in the interior space bounded by said internal frame of said double-walled filling frame during operation of said compacting means.

54. The apparatus as defined in claim 53, wherein:

said at least one aperture comprises a predetermined number of apertures distributed over said predetermined height of said filling frame.

55. The apparatus as defined in claim 53, wherein:

said internal frame of said double-walled filling frame widens along its predetermined height in a substantially conical manner in a direction towards said molding frame.

56. An apparatus for manufacturing a foundry mold, especially for compacting foundry molding material, comprising:

a pattern plate;

at least one mold pattern mounted on the pattern plate;

a molding frame surrounding the at least one mold pattern and defining an interior space partially filled by the at least one mold pattern and for receiving foundry molding material;

a filling frame mounted on top of the molding frame and defining an interior space for receiving the foundry molding material;

compacting means arranged on top of the filling frame for compacting the foundry molding material;

said pattern plate, said at least one mold pattern, said molding frame, said filling frame and said compacting means conjointly constituting mold frame means;

said mold frame means containing at least one aperture for infeeding into and expanding a preselected gas in predetermined local regions of said foundry molding material in order to thereby transiently produce said predetermined local regions which possess reduced packing density in said foundry molding material during operation of said compacting means;

said filling frame constituting a double-walled filling frame;

said double-walled filling frame containing an internal frame which bounds an interior space of said double-walled filling frame and which receives said foundry molding material in a predetermined portion of such interior space during operation of said mold frame means; and said internal frame of said double-walled filling frame widening in a substantially conical manner in a direction towards said molding frame.

* * * * *

UNITED STATES PATENT AND TRADEMARK OFFICE

CERTIFICATE OF CORRECTION

PATENT NO. : 4,750,540

DATED : June 14, 1988

INVENTOR(S) : DIETMAR BOENISCH

It is certified that error appears in the above-identified patent and that said Letters Patent is hereby corrected as shown below:

Column 5, line 45, please delete "means" and insert --agent--

Column 7, line 37, please delete "passae" and insert --passage--

Column 7, line 64, please delete "opertion" and insert --operation--

Column 7, line 68, please delete "value" and insert --valve--

Column 10, line 30, please delete "degrees" and insert --degree--

Column 13, line 25, please delete "20" and insert --29--

Column 22, line 38, please delete "and"

Column 28, line 31, please delete "pressure" and insert --pressing--

Signed and Sealed this

Twenty-ninth Day of November, 1988

*Attest:*

*Attesting Officer*

DONALD J. QUIGG

*Commissioner of Patents and Trademarks*